US009290922B2

(12) United States Patent
Bernabei et al.

(10) Patent No.: US 9,290,922 B2
(45) Date of Patent: Mar. 22, 2016

(54) CERAMIC TOILET BOWL AND METHOD FOR MANUFACTURING THE BOWL

(75) Inventors: Alessandro Bernabei, Imola (IT); Vasco Mazzanti, Imola (IT)

(73) Assignee: SACMI COOPERATIVA MECCANICI IMOLA SOCIETA' COOPERATIVA, Imola (IT)

( * ) Notice: Subject to any disclaimer, the term of this patent is extended or adjusted under 35 U.S.C. 154(b) by 380 days.

(21) Appl. No.: 14/111,241

(22) PCT Filed: Apr. 13, 2012

(86) PCT No.: PCT/IB2012/051824

§ 371 (c)(1),
(2), (4) Date: Oct. 11, 2013

(87) PCT Pub. No.: WO2012/140607

PCT Pub. Date: Oct. 18, 2012

(65) Prior Publication Data

US 2014/0026311 A1 Jan. 30, 2014

(30) Foreign Application Priority Data

Apr. 15, 2011 (IT) ..... BO2011A0201

(51) Int. Cl.
*E03D 11/02* (2006.01)
*B28B 1/00* (2006.01)
(Continued)

(52) U.S. Cl.
CPC ..... *E03D 11/02* (2013.01); *B28B 1/002* (2013.01); *B28B 1/14* (2013.01); *B28B 1/26* (2013.01)

(58) Field of Classification Search
CPC ..... E03D 11/02; B28B 1/002; B28B 1/14; B28B 1/26
USPC ..... 4/429, 420
See application file for complete search history.

(56) References Cited

U.S. PATENT DOCUMENTS 7,661,153 B2 2/2010 Nakamura et al.
8,007,619 B2 8/2011 Bernabei et al.
(Continued)

FOREIGN PATENT DOCUMENTS

CN 1454276 A 11/2003
CN 1675436 A 9/2005
(Continued)

*Primary Examiner* — Huyen Le
(74) *Attorney, Agent, or Firm* — Pearne & Gordon LLP

(57) ABSTRACT

A ceramic bowl obtained by means of casting in moulds comprises: a liquid collection pan (2) having a main axis (Z) of extension; a liquid distribution rim (3) having at least one portion configured to reproduce the top edge (7) of the pan (2) along a common plane (P) of lie; the rim portion (3) has a tubular chamber (4) with toroidal cross-section for the passage of liquids and having as axis of rotation the axis (Z) of the pan (2); a separate outer casing (5) for housing the single component formed by pan (2) and rim (3); the bowl comprises a first set of perimetral surfaces (8, 14, 31) which define one part of the tubular chamber (4) of the rim (3) and the surface joining the rim portion (3) to the pan (2) and which are parallel to each other and extend in a direction transverse to the common plane (P) of lie, and a second set of perimetral surfaces (6, 12) which define the other part of the tubular chamber (4) and extend parallel to the plane (P) of lie and are connected to the first set of surfaces (8, 14, 31) so as to configure continuous outer surfaces devoid of recesses or projections; one of the surfaces (12) of this second set defining the top wall of the tubular chamber (4) is provided with a projecting flange (13) forming a surface (3) for resting the rim (3) on a top surface (15) of the casing (5).

16 Claims, 5 Drawing Sheets

(51) Int. Cl.
*B28B 1/26* (2006.01)
*B28B 1/14* (2006.01)

(56) References Cited

U.S. PATENT DOCUMENTS

2003/0115664 A1 6/2003 Kosugi et al.
2003/0140406 A1 7/2003 Miwa et al.
2005/0166308 A1 8/2005 Miwa et al.
2006/0005310 A1 1/2006 Nakamura et al.
2007/0124913 A1* 6/2007 Davies ..... B28B 1/002 29/527.3
2009/0019630 A1* 1/2009 Bernabei ..... B28B 1/002 4/420
2012/0260415 A1* 10/2012 Chi ..... E03D 11/02 4/421

FOREIGN PATENT DOCUMENTS

CN 1769605 A 5/2006
CN 101481926 A 7/2009
EP 2017391 A2 1/2009
JP 2005113519 A 4/2005

* cited by examiner

CERAMIC TOILET BOWL AND METHOD FOR MANUFACTURING THE BOWL

FIELD OF THE INVENTION

The present invention relates to a ceramic toilet bowl and method for manufacturing the bowl.

BACKGROUND ART

At present, a conventional ceramic bowl is obtained by pressure-casting a suspension referred to in the technical jargon of the sector as "slip".

The bowl is composed of two parts which are combined with each other: a first operative bottom part, or "active part", comprising a pan and a drainage siphon (namely the inner zones of the bowl), and a second top part or "rim".

In this connection, the first part or active part constitutes the functional part of the bowl and must have dimensional characteristics which are suitable for ensuring correct operation of the bowl as a pan for collecting and discharging the liquid flow.

The rim has a portion thereof configured to reproduce the extension of the top edge of the pan which it covers (for example, but not necessarily, an ellipsoidal form) and a rear extended part which is parallel to the extension of the siphon and in which a through-hole for supplying the flushing water is formed.

This rim part may be made in two definite forms which are referred to in the technical jargon of the sector as "open rim" and "closed rim".

In the case of an open rim its portion covering the edge of the pan has a cross-section in the form of an overturned "U" with its bottom surface open so as to allow the passage of the flushing water.

In the case of a closed rim, instead, its portion covering the edge of the pan has a cross-section of the partially closed toroidal type in which, on the wall facing the pan, a plurality of convolutions or holes for discharging the water are formed.

In this connection, in the manufacturing technology based on the high-pressure casting of slip inside moulds, the active part and the rim are made separately (at least as regards the said closed rim).

Only subsequently are the rim and the active unit joined together by bonding the rim onto the top edge of the pan.

The joining operation is performed using the parts in a "fresh" state, i.e. when the parts still have a high percentage of water and have just been extracted from the mould. The reason why the parts are bonded in the fresh state is that, following bonding, the parts may undergo finishing (performed also using robot units), ensuring a good surface continuity, i.e. an attractive appearance of the bowl.

In the current market there is an ever-increasing demand for toilet bowl designs which are such that large areas of the functional components (viz. pan) must be covered and that essentially casings of different shapes and sizes must be provided in each case.

In order to be able to produce this type of bowl it is required to create moulds with very large and complex "free thickness" zones with consequent high costs and not insignificant problems from a technological point of view.

In fact, "free thickness" moulds allow maximum freedom as regards the aesthetic form of the articles, with different dimensional ratios inside the mould and, therefore, with the presence of large-volume casting cavities.

In this connection, the cavity inside the mould is not distinguished by a male/female mating arrangement (as in preset-thickness moulds), but the walls of the product are formed by a single internal surface of the mould.

Basically, therefore, the requirement for bowls with different aesthetic designs results in a reduction in standardization of the manufacturing parts with a corresponding diversification both of the mould types and the manufacturing operations with a possible increase in cost of the finished article.

An example of a bowl is known from the document US 2005/0166308 where the rim is bonded onto the pan after the corresponding forming operations inside two different moulds.

The pan is formed with outer covering walls formed simultaneously with its functional inner part, so as to act as an outer support structure which in practice is varied depending on the type of aesthetic model to be produced.

The Applicant, therefore, in an attempt to respond to this demand more effectively, has devised a ceramic toilet bowl described in patent application EP 2017391.

In this solution the bowl comprises a first bottom part, which is composed of the liquid collection pan with a liquid-drainage siphon portion, and a second top part or rim, which is composed of the front portion forming the top edge of the pan and a rear extended part inside a liquid passage channel is provided.

The bowl is formed with at least the pan and the rim (and optionally also the siphon) as a single body inside the mould so as to define a single part to which a third covering part, or outer casing, is added, the latter housing the single part configured so as to be joined to the casing at least along the top edges of the latter.

With such a design of toilet bowl it is possible to manufacture a single standardized part comprising all the functional components of the product, while the aesthetic features of the final product are provided on the casing portion.

However, during the industrial implementation of this solution, a number of problems associated with the particular configuration of the rim and the consequent structural design of the moulds required to produce the bowl have arisen.

In particular, the perimetral form of the rim and, secondarily, if present during casting in the mould, the configuration of the siphon, create particular undercuts or recesses and/or projections in the form of the product such as to require the presence of at least three mould parts in order to obtain the part: two lateral half-moulds, configured to obtain the outer surface of the finished part, and a central piston/mould for closing the first two half-moulds in order to produce the inner rim/pan part and, optionally, the siphon.

In addition it should be added that the mould may have up to four parts, for particular bowl designs, with the introduction of an insert which is separate from the lateral parts.

This mould is therefore managed, when opened and closed, by means of movements along a horizontal axis (first two lateral mould-halves) and along a vertical axis (central piston/mould).

In this connection, therefore, the plant required to produce the bowl in question requires essentially at least two moulds consisting of three parts, each of which with a corresponding movement necessary for: forming the pan/rim component (with optional siphon) as one piece and a similar mould for the production of the casing.

The large number of said components thus complicates, increases the cost and also partly slows down the production of the bowl thus designed, cancelling out partly the advantages resulting from the standardization of the product thus configured.

DISCLOSURE OF THE INVENTION

The object of the present invention is to provide a ceramic bowl which overcomes the aforementioned drawbacks of the prior art.

In particular, an object of the present invention is to provide a ceramic bowl able to ensure standardized production of the functional components, simplifying the manufacture thereof.

A further object of the present invention is to propose a ceramic bowl which is able to ensure that its own production cycle may be performed more rapidly and using less costly equipment.

A further object is to propose a method for manufacturing the ceramic bowl, which is extremely rapid, using a smaller of a parts and at a lower cost.

Said objects are fully achieved by means of the ceramic bowl and the associated method according to the present invention which are characterized by the contents of the claims provided below.

In particular, the method for forming this bowl comprises the step of providing a first mould composed of a single bottom female die closed by an extractor unit or top male part, movable so as to be opened and closed along an axis perpendicular to the common plane P of the die and parallel to the main axis of extension.

According to the invention, the die and the extractor are configured, during use, with a first set of perimetral surfaces forming the tubular chamber and a wall joining together rim and pan, which are oriented parallel to each other, and a second set of forming surfaces for joining together the preceding surfaces; the second set of surfaces is oriented transversely with respect to the axis of extension and along the plane of the die so as to obtain a first mould with continuous surfaces devoid of cavities or projections, i.e. devoid of irregularities.

The method according to the invention also comprises the steps of forming the pan and the rim by means of casting inside the first mould; providing a second mould for forming the casing; forming the casing by means of casting inside the second mould; raising the extractor unit from the die of the first mould (stationary in position) for complete extraction of pan and rim as a single body from the mould; opening the second mould in order to prepare the top part of the casing for housing pan and rim; inserting and resting the pan and rim inside the casing.

Owing to this method and the design of the die and the extractor, the mould-extraction step is performed in a single raising operation.

This is possible owing to the linearity, without cavities or irregularities, of the forming surfaces.

The invention also provides a ceramic bowl obtained by means of casting in moulds and comprising a liquid collection pan with a main axis of extension, a liquid distribution rim with a portion configured to reproduce the top edge of the pan in a common plane of the die; the rim portion has a tubular chamber with toroidal cross-section for the passage of liquids having as axis of rotation the axis of the pan, and a separate outer casing for housing the single component formed by pan and rim.

According to the invention, the bowl has a first set of perimetral surfaces which define one part of the tubular chamber of the rim and the surface joining the rim portion to the pan and which are parallel to each other and extend in a direction transverse to the common plane of lie, and a second set of perimetral surfaces which define the other part of the tubular chamber and extend parallel to the plane of the die and are connected to the first set of surfaces so as to configure continuous outer surfaces which are devoid of cavities or projections.

According to the invention, the bowl also has one of the surfaces of said second set, defining the top wall of the tubular chamber, which is provided with a projecting flange forming a surface for resting the rim on a top surface of the casing.

Owing to the particular simplified constructional design of the rim and the pan part joined thereto with continuous surfaces which are devoid of cavities or projections extending substantially horizontally and are oriented towards the inside or the outside of the pan or the rim these two parts may be produced in a single mould consisting of only two parts and with a single opening and closing movement of the mould which, in fact, is parallel to or coincides with the main axis of extension of the pan.

This particular configuration, therefore, simplifies the structure and speeds up the production cycle, ensuring optimum technical, functional and aesthetic features of the bowl.

In other words, there is an evolution in the design of the rim which is structured so as to have a particular linear geometry of the outer surfaces transverse to the plane of the die, resulting in a single direction of extraction of the pan/rim unit from the mould, i.e. along a single movement axis of the mould parts.

Preferably, the perimetral surfaces of the tubular chamber transverse to the common plane of the die have an extension parallel to each other and define the inner and outer side walls of the tubular chamber with respect to the pan.

Even more preferably, the surface section joining together pan and rim is also parallel to the two side walls of the rim.

In this connection, the three surfaces have an orientation converging towards the axis of extension of the pan, i.e. inclined towards the bottom of the pan.

Preferably, the tubular chamber of the rim has a bottom surface joined, at its end, to the pan joining surface so as to form, together with the said pan, a substantial right angle defining a projecting outer extended part of the pan itself Basically, the tubular chamber widens towards the outside of the pan and narrows partly towards the inside of said pan with a quadrangular configuration also defined by the two surfaces which are transverse to the axis of extension of the pan and are flat and devoid of substantially horizontal cavities or projections.

Preferably, the rim portion comprises a flange inside the pan, extending substantially vertically and defining the inner side surface of the tubular chamber.

In this connection, the flange is configured with its bottom free portion partially facing the top edge of the pan and the joining surface so as to define a channel for discharging liquid passing through the tubular chamber.

This design of the inner part of the tubular chamber combines the side closure of the tubular chamber with the formation of the fluid discharge channel by means of a linear structure devoid of undercuts, i.e. cavities or projections.

Preferably, moreover, the flange defining the side surface of the tubular chamber and the pan joining surface are configured to obtain dimensional variations in their relative distance so as to define narrower zones or wider zones of the liquid discharge channel.

In this connection, the pan joining surface is formed with an undulating form along its entire extension so as to vary the distance from the flange.

Preferably, by varying the undulation arc of the pan it is also possible to obtain an intermediate portion of the flange which is joined to a section joining together the bottom surface and the top edge of the pan so as to configure a closed zone along the extension of the tubular chamber, thereby defining a closed rim.

Preferably, the bottom surface of the tubular chamber comprises protrusions projecting towards the inside of the said tubular chamber for distributing the passing liquid.

This feature results in a further additional element inside the tubular chamber (constriction and channelling of the liquid passage) without affecting the outer perimetral form of the pan.

Preferably, the pan comprises a siphon portion for draining the liquids from the pan, formed as a single body with the casing.

This measure helps simplify the pan/rim unit being formed in the corresponding mould, by assigning to the casing mould the formation of the functional component.

Alternatively, the liquid-drainage siphon portion is always separate from the pan and also from the casing and is combined with the bottom of the pan itself when the pan, together with the rim, is housed inside the casing.

This further technical measure results in the possibility of being able to choose subsequently the type of siphon to be applied to the pan components already obtained.

BRIEF DESCRIPTION OF THE DRAWINGS

This feature, together with others, will emerge more clearly from the following description of a preferred embodiment illustrated purely by way of a non-limiting example in the accompanying sets of drawings in which.

Figure 1:
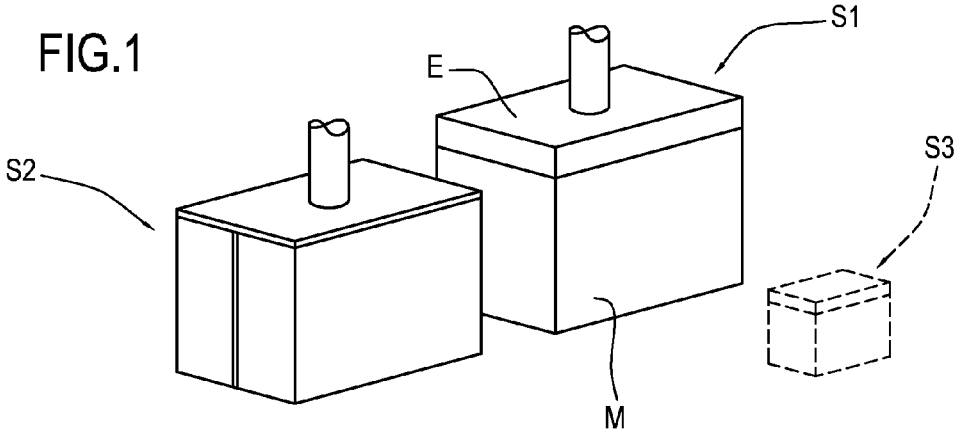
FIG. 1 shows a schematic perspective view of a plant for the manufacture of the toilet bowl according to the present invention.

Detailed DESCRIPTION OF THE PREFERRED EMBODIMENTS OF THE INVENTION

According to the accompanying figures and with particular reference to FIGS. 1 to 5, the method for forming the ceramic toilet bowl, denoted overall by 1, is performed by means of casting a liquid (called "slip") inside porous-resin moulds.

The bowl to be produced comprises a liquid collection pan 2 having a main axis Z of extension and a liquid distribution rim 3 having a portion configured to reproduce the top edge 7 of the pan 2 to which it is joined along a common plane P of the die.

"Main axis of extension" is understood as meaning the longitudinal axis of extension of the pan 2 which is composed of a top portion with a broad cross-section extending as far as a bottom or base portion with a cross-section narrower than the previous portion.

In this connection, the rim portion 3 has a tubular chamber 4 with toroidal cross-section for the passage of liquids and having as axis of rotation generating the toroid the aforementioned main axis Z of extension of the pan 2.

The rim 3 and the pan 2 are formed as a single body so as to define a single component.

The bowl 1 comprises an outer casing 5 for housing the single component formed by the pan 2 and the rim 3.

Preferably, the casing 5 houses and covers completely the pan 2, while a part of the rim 3 (at least the top flat surface) remains visible on the outside of the casing 5.

Figure 2:
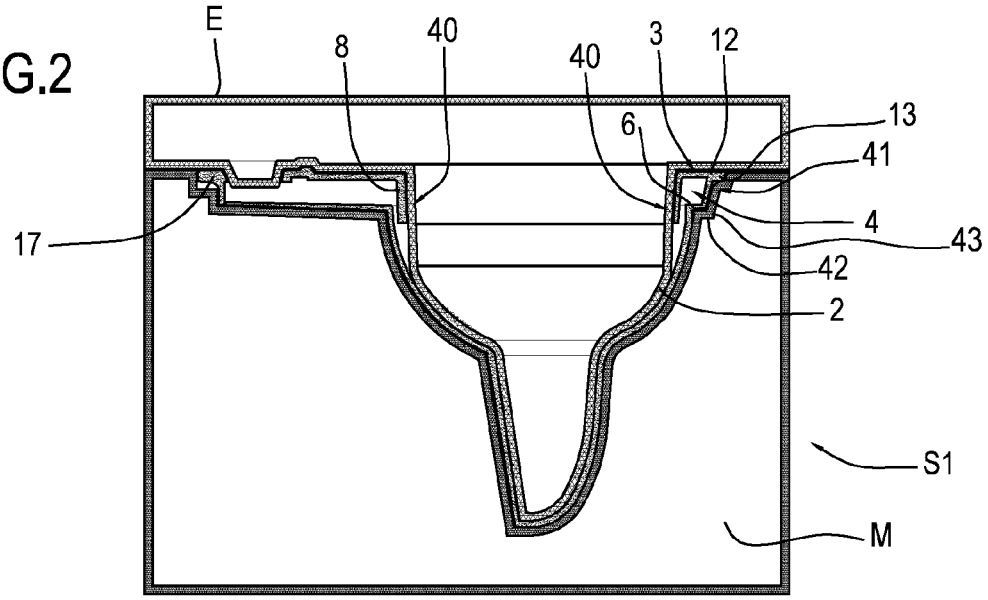
FIG. 2 shows a sectioned side view of a single-body pan and rim forming part of the toilet bowl in question inside the closed forming mould.
Figure 3:
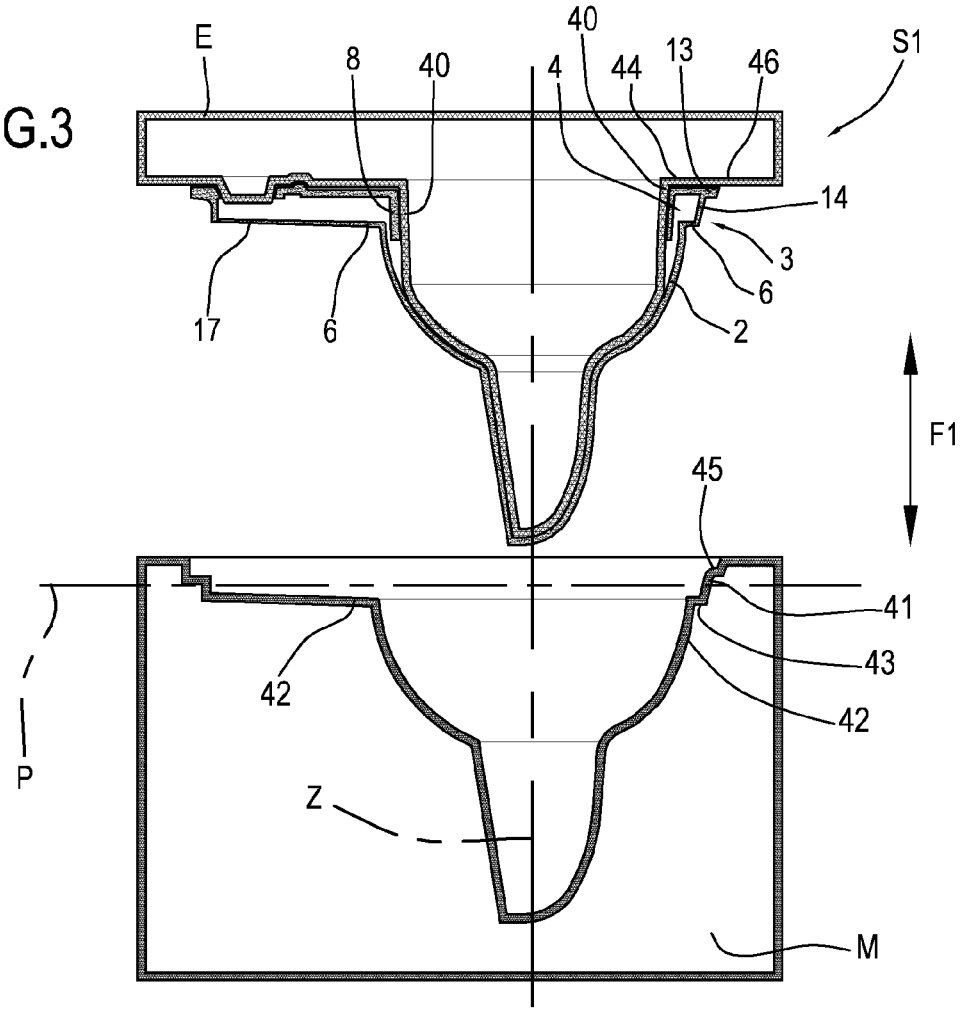
FIG. 3 shows a sectioned side view of the single-body pan and rim forming part of the toilet bowl in question inside the open forming mould.
Figure 4:
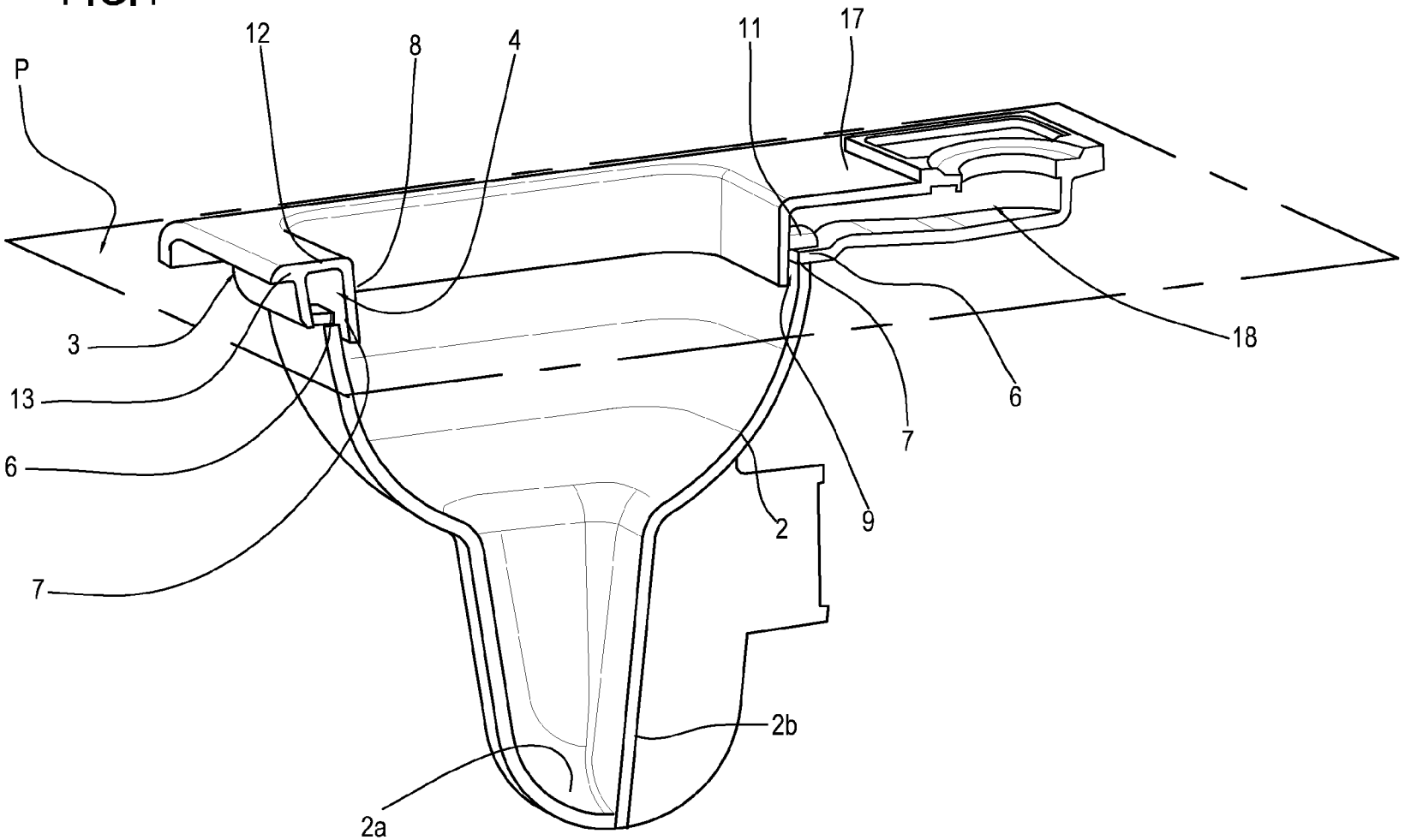
FIG. 4 shows a perspective and partially sectioned view of the single-body pan with rim according to FIGS. 2 and 3.
Figure 5:
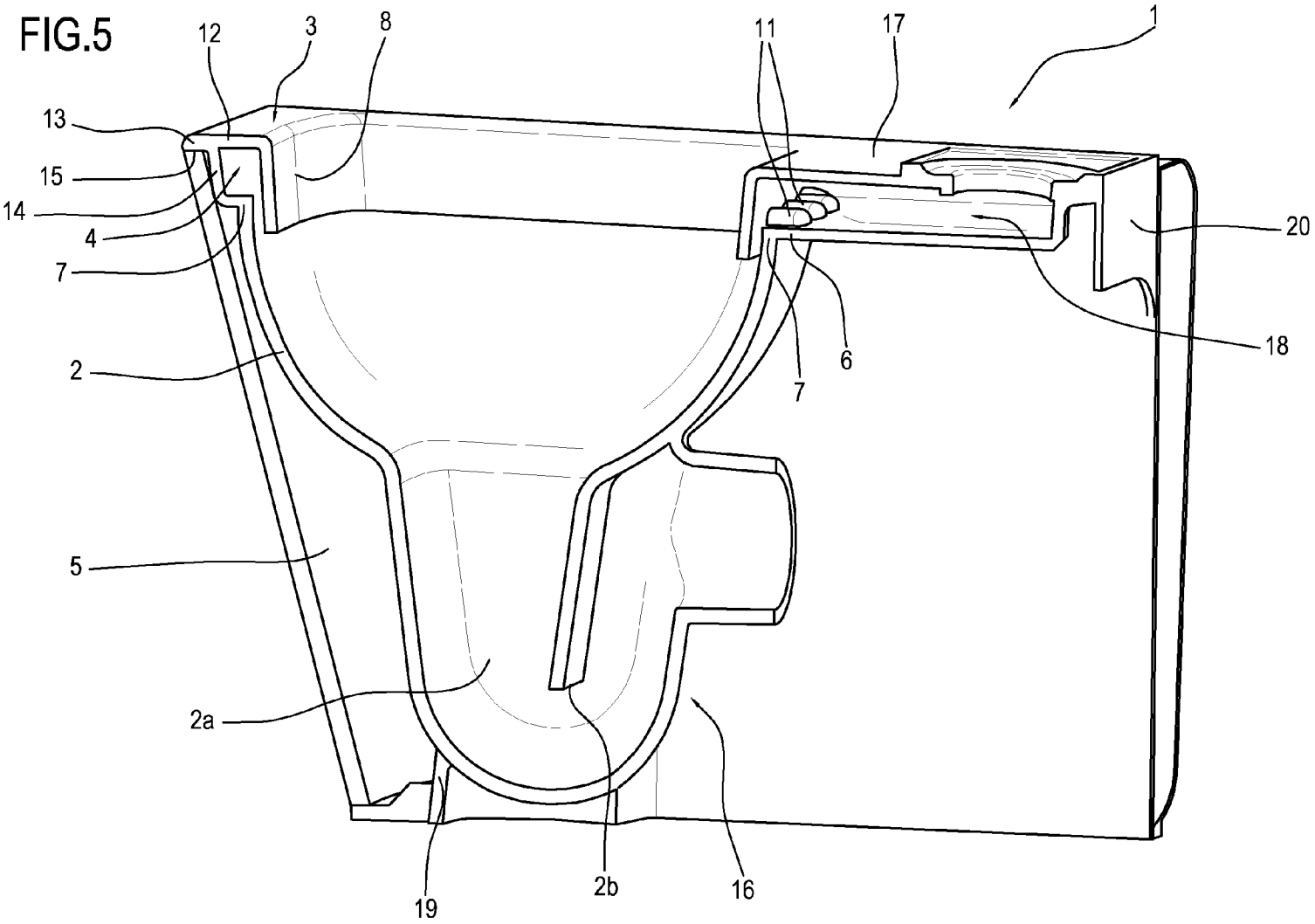
FIG. 5 shows a partially sectioned, side perspective view of the toilet bowl according to the present invention.

According to the invention, the method for forming this bowl 1 comprises the step of providing a first mould Si composed of a single bottom female die M closed by an extractor unit E or top male part, movable so as to be opened and closed along an axis perpendicular to the common plane P of the die and parallel to the main axis Z of extension of the pan 2 (see FIGS. 1 and 2).

Still according to the invention, the die M and the extractor E are configured, during use, with a first set of perimetral surfaces 40, 41, 42 forming the tubular chamber 4 and a wall 31 joining together rim 3 and pan 4, which are oriented parallel to each other, and a second set of forming surfaces 43, 44 for joining together the preceding surfaces 40, 41, 42 (see FIGS. 1 and 2).

This second set 43 and 44 is oriented transversely with respect to the axis Z of extension and extends parallel to the plane P of the die so as to obtain a first mould S1 with continuous surfaces devoid of cavities or projections, i.e. devoid of irregularities.

Figure 9:
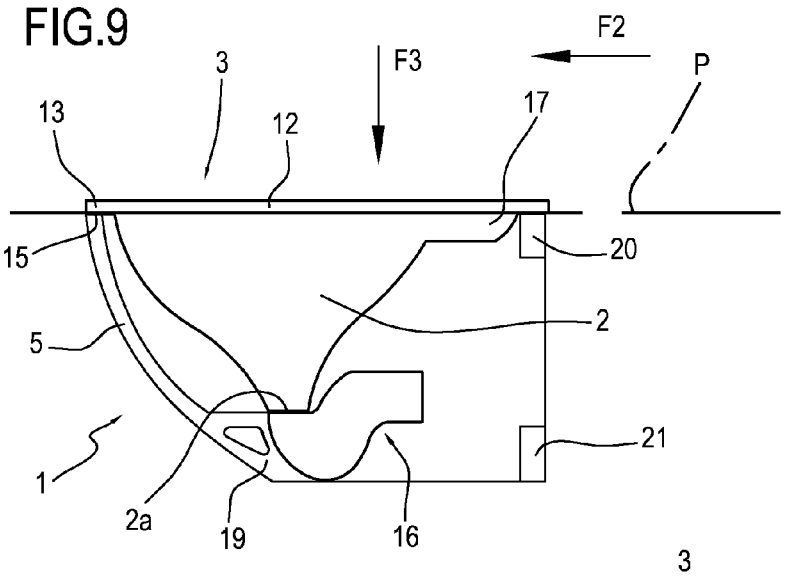
FIGS. 9 to 11 show two different constructional configurations and corresponding different operative stages of manufacture of the toilet bowl, all the figures being schematic side views with some parts removed so that other parts may be seen more clearly.

Still according to the invention, the method comprises the steps of:

- forming the pan 2 and the rim 3 by means of casting inside the first mould S1;
- providing a second mould S2 for forming the casing 5;
- forming the casing 5 by means of casting inside the second mould S2;
- raising the extractor unit E from the die M (in a single movement, see FIG. 3 and arrow F1) in order to extract fully pan 2 and rim 3 as a single body from the mould;
- opening the second mould S2 in order to prepare the top part of the casing 5 for housing pan 2 and rim 3;
- inserting and resting the pan 2 and rim 3 inside the casing 5 (see FIG. 9 and arrows F2 and F3).

Preferably, the method comprises a step of joining the drainage siphon portion 16 to the bottom of the pan 2, following insertion of the pan 2 and rim 3 inside the casing 5.

Preferably, the step of forming the casing 5 inside the second mould S2 comprises the simultaneous formation of a siphon portion 16 for draining liquids from the pan 2.

Preferably, the method comprises a step of applying adhesive to the top edge of the siphon portion 16 (for example "slip" with a higher percentage water content).

Figure 10:
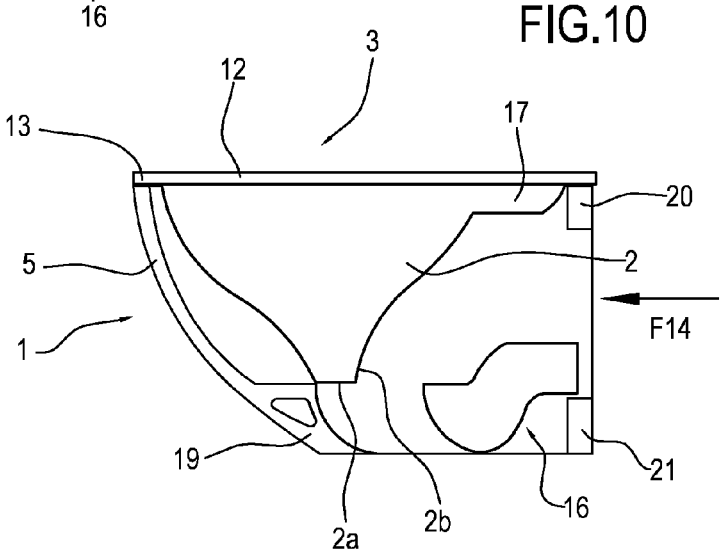

Alternatively, the method comprises the further steps of:

- providing a third mould S3 for forming a liquid-drainage siphon portion 16 for the bottom of the pan 2;
- forming the drainage siphon portion 16 by means of casting inside the third mould S3, housing the drainage siphon portion 16 inside the casing 5 following insertion of the pan 2 and the flange 3 inside the casing 5 (see arrow F4 in FIG. 10);

joining the siphon 16 to the bottom of the pan 2.

Preferably, prior to the step of housing the siphon portion 16 inside the casing 5, adhesive is spread over the top part of the siphon portion 16 intended to be joined to the bottom of the pan 2.

Preferably, the pan 2 is prepared for joining to the siphon portion 16 by means of removal of ceramic material from the bottom zone which comprises the base and a partial rear side surface.

Preferably, the die M and the extractor E are configured, during use, with a two further forming surfaces 45 and 46 defining a projecting flange 13 of the rim 3.

The invention also provides a ceramic bowl 1.

As mentioned above, the bowl 1 comprises a liquid collection pan 2 with a main axis Z of extension and a liquid distribution rim 3 with a portion configured to reproduce the top edge 7 of the pan 2 to which it is joined along a common plane P of the die.

In this connection, the rim portion 3 has a tubular chamber 4 with toroidal cross-section for the passage of liquids and having, as axis of rotation generating the toroid, the aforementioned main axis Z of extension of the pan 2.

The rim 3 and the pan 2 are formed as a single body so as to define a single component.

The bowl 1 comprises an outer casing 5 for housing the single component formed by the pan 2 and the rim 3.

Preferably, the casing 5 houses and covers completely the pan 2, while a part of the rim 3 (at least the top flat surface) remains visible on the outside of the casing 5.

According to the invention, the bowl 1 comprises:

a first set of perimetral surfaces 8, 14, 31 which define one part of the tubular chamber 4 of the rim 3 and the surface joining together pan 2 and rim portion 3 and which are parallel to each other and extend in a direction transverse to the common plane P of the die.

Still according to the invention, the bowl 1 comprises a second set of perimetral surfaces 6, 12 which define the other part of the tubular chamber 5 and extend parallel to the plane P of the die and are connected to the first set of surfaces 8, 14, 31 so as to configure continuous outer surfaces which are devoid of cavities or projections on the pan/rim portion.

Still according to the invention, the bowl 1 has one 12 of the surfaces of said set, defining the top wall of the tubular chamber 4, which is provided with a projecting flange 13 forming a surface for resting the rim 3 on a top surface 15 of the casing 5.

Preferably, the first set of surfaces has the two surfaces of the rim 3 defining the outer side 14 and the inner side 8 of the tubular chamber 4 and the surface 31 connecting pan 2 and rim 3 which extend in a linear manner inclined towards the centre of the pan 2.

Preferably, these three surfaces 8, 14, 31 are substantially parallel to each other.

Overall, therefore, the geometry of the perimetral surfaces of the two sets are oriented parallel to each other, for each set, and such as to define a form of the top part of the bowl 1 with linear connecting surfaces arranged parallel or transverse to the axis Z or to the common plane P of the die so as to obtain a geometry of the said surfaces which is generally without irregularities.

Preferably, the volume of the tubular chamber 4 is partially bounded also by the joining surface 31 defining the top edge 7 of the pan 2 and the rim 3.

In this connection, in fact, the joining surface 31 is joined, without interruption, to the bottom surface 6 of the rim 3 so as to produce a projection of the edge of the pan 3 towards the outside of the said pan 2.

Owing to this geometric feature described hitherto, the configuration of the tubular chamber 4 is obtained with a substantially quadrangular cross-section devoid of cavities or projections formed so as to be directed horizontally both towards the inside and towards the outside of the pan 2.

As a result of these geometrical features it is possible to produce pan 2 and rim 3 inside a substantially single mould in which there is only one direction of opening of the two parts: namely perpendicular to the common plane P of the die of the pan 2 and rim 3 and parallel to main axis Z of extension of the pan 2 (as seen above).

Figure 6:
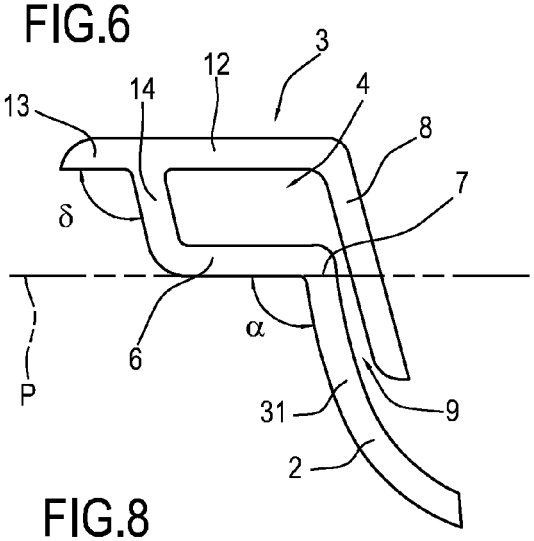
FIG. 6 shows a sectioned front view of a detail of the tubular chamber of the rim according to FIG. 4.

Preferably, the rim 3 comprises the tubular chamber 4, the bottom surface 6 of which is joined, at its end, to the joining surface 31 (in particular to the top edge 7 thereof) of the pan 2 so as to form a substantial right angle a which defines a projecting outer extended part of the pan 2 itself (see FIG. 6).

Preferably, the rim portion 3 comprises a flange 8 inside the pan 2 (defining one of the surfaces transverse to the common plane P of the die), extending substantially vertically and defining the inner side surface of the tubular chamber 4.

In this connection, the flange 8 is configured with its bottom free portion partially facing the top edge 7 of the pan and the joining surface 31 of the pan 2 so as to define a channel 9 for discharging liquid passing through the tubular chamber 4.

More particularly, the flange 8 extends beyond the top edge 7 of the pan 2 so as to face also a bottom portion of the joining surface 31 of the pan 2 and at a constant distance so that the liquid discharge channel 9 is defined longer in order to direct better the outgoing liquid.

Alternatively, the flange 8 and the joining surface 31 of the pan 2 are configured to obtain dimensional variations in their relative distance so as to define narrower zones or wider zones of the liquid discharge channel 9.

Preferably, this design detail is obtained by providing the joining surface 31 of the pan 2 with an undulating form.

In an alternative, but not limiting solution, this design is obtained by varying the angle β of inclination with which the flange 8 is formed with respect to the topβ wall 12 of the tubular chamber 4.

Figure 7:
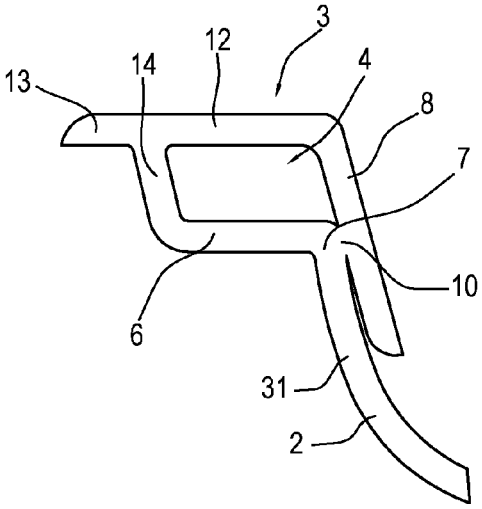
FIG. 7 shows a variation of embodiment, with respect to FIG. 6, of a detail of the rim chamber.

In both the possibilities described, the inner flange 8 of the tubular chamber 4 has an intermediate portion 10 thereof which is joined to a section joining together bottom surface 6 and top edge 7 of the pan 2 so as to configure a closed zone along the extension of the tubular chamber 4: this zone, alternating with open zones of the tubular chamber 4, defines a closed rim (see FIG. 7).

Figure 8:
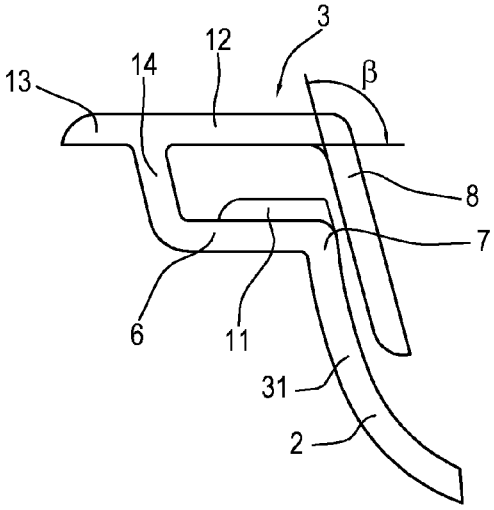
FIG. 8 shows a different cross-sectional view of the rim chamber, compared to the preceding FIGS. 6 and 7, in which the projections inside the rim can be seen.

Preferably, the bottom surface 6 of the tubular chamber 4 comprises protrusions 11 projecting towards the inside of the said tubular chamber 4 for distributing the passing liquid (see FIG. 8).

In this connection, the protrusions 11 are distributed along the entire tubular chamber 4 alternating with linear sections of the bottom surface 6.

This configuration of the bottom of the tubular chamber 4 allows controlled constriction and distribution of the passing liquid in such a way as to optimize its distribution along the entire chamber 4 and therefore along the inner wall of the pan 2.

As mentioned above, the rim portion 3 comprises the surface 12 defining the top wall of the tubular chamber 4 provided with the flange 13 projecting from the outer side surface 14 of the tubular chamber 4.

In this connection, the projecting flange 13 defines a surface for resting the rim 3 on the top surface 15 of the casing 5.

Still in this connection, the flange 13 forms an angle δ with the outer side wall 14 and is substantially parallel to the bottom surface 6 of the tubular chamber 4.

Still according to the invention, the bowl 1 comprises a siphon portion 16 for draining the liquids from the pan 2, configured to be connected to the bottom of the pan 2 housed inside the casing 5.

In this connection, the bowl 1 in question comprises the siphon portion 16 for draining the liquids from the pan 2, formed as a single body with the casing 5 (FIG. 9).

Preferably, this siphon portion 16 is formed on the bottom of the casing 5.

This feature results in further simplification of the initial configuration of the components of the bowl 1 and therefore of the plant.

Moreover, this feature increases the speed of assembly of the components of the bowl 1 by making use of the step involving insertion of the pan 2 with rim 3 inside the casing 5 for joining also the bottom of the pan 2 to the siphon portion 16.

Preferably, the siphon portion 16 is formed together with a reinforcing rib 19 inside the casing 5.

This rib 19, together with a rear bracket 20 and rib 21, also have the function of partially supporting the pan 2 and part of the rim 3 inside the said casing 5.

Figure 11:
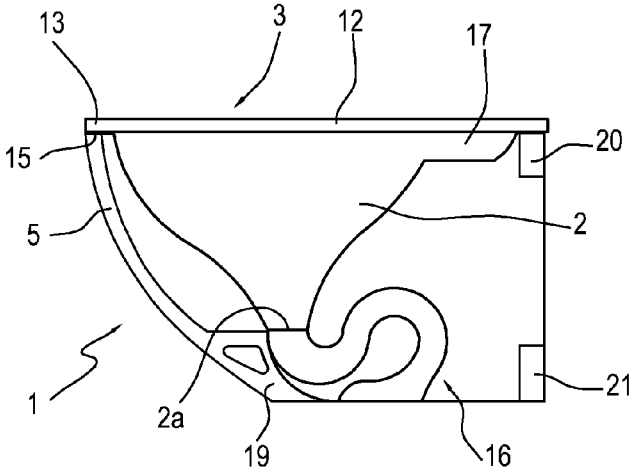

Alternatively (see FIGS. 10 and 11 showing two different configurations of the siphon duct), the liquid-drainage siphon portion 16 of the bowl 1 is separate from the pan 2 and combined with the bottom of the pan 2 itself housed inside casing 5.

In this case, the siphon portion 16 is formed separately from the components of the bowl 1 and then applied to the bottom of the pan 2 already housed inside the casing 5.

This feature allows the type of siphon duct 16 which is to be inserted inside the bowl 1 to be chosen subsequently.

The zones of contact between the siphon portion 16 and the bottom of the pan 2 are configured so as to fit together during the final joining operation.

In this connection, the pan 2 is open on its bottom 2*a* and/or on its side surface 2*b* depending on the type of siphon portion 16 fitted, i.e. the type of opening present on the siphon portion 16.

Preferably, the rim 3 comprises a second rear portion 17 which is defined by an extended part of the portion generating the tubular chamber 4 and inside which a liquid supply channel 18 for the tubular chamber 4 is formed.

With a method and a bowl thus designed the predefined objects are achieved owing to the particular constructional form of the pan and the rim.

In particular, owing to the geometric continuity of the top edge of the pan and the bottom part of the rim, together with the linearity of the surfaces defining the tubular chamber, it is possible to obtain a form without horizontally extending cavities or recesses so that the two combined components may be obtained in a single mould consisting of only two parts and having an extremely simple structure.

All this is achieved while ensuring high standards in terms of quality and appearance of the bowl and, in particular, reliable operation of the bowl as a whole.

By means of separation of the siphon portion from the pan it is possible to simplify further the mould for forming the pan with rim, while at the same time allowing choice of the type of siphon portion most suited for the final needs.

This increases the capacity of adaptation of the bowl product not only in terms of range of aesthetic design but also as regards the functional requirements of the environment in which it is to be installed.

The invention claimed is:

1. A method for manufacturing a toilet bowl (1) comprising:

a liquid collection pan (2) having a main axis (Z) of extension;

a liquid distribution rim (3) having at least one portion configured to reproduce the top edge (7) of the pan (2) along a common plane (P) of a die; said portion having a tubular chamber (4) with toroidal cross-section for the passage of liquid and having as generating axis the said axis (Z) of the pan (2);

a separate outer casing (5) configured to house the pan (2) and the rim (3), wherein it comprises the following steps:

providing a first mould (S1) composed of a single bottom female die (M) closed by an extractor unit (E) or top male part, movable so as to be opened and closed along an axis perpendicular to the common plane (P) of the die and parallel to the main axis (Z) of extension; said die (M) and said extractor (E) being configured, during use, with a first set of perimetral surfaces (40, 41, 42) forming one part of the tubular chamber (4) and a wall (31) joining together rim (3) and pan (4), which are oriented parallel to each other, and a second set of forming surfaces (43, 44) for joining together the preceding first set (40, 41, 42); said second set (43, 44) being oriented transversely with respect to the main axis (Z) of extension and parallel to the plane (P) of the die so as to obtain a first mould (S1) with continuous surfaces devoid of cavities or projections, i.e. devoid of irregularities;

forming, by means of casting in the first mould (S1), the pan (2) and the rim (3);

providing a second mould (S2) for forming the casing (5);

forming the casing (5) by means of casting inside the second mould (S2);

raising the extractor unit (E) from the die of the first mould (S1) in order to extract fully pan (2) and rim (3) as a single body from the mould;

opening the second mould (S2) in order to prepare the top part of the casing (5) for housing pan (2) and rim (3);

inserting and resting the pan (2) and rim (3) inside the casing (5).

2. The method according to claim 1, wherein the step of forming the casing (5) inside the second mould (S2) comprises the simultaneous formation of a siphon portion (16) for draining liquids from the pan (2).

3. The method according to claim 1, comprising a step of joining a drainage siphon portion (16) to the bottom of the pan (2), following the insertion of pan (2) and rim (3) inside the casing (5).

4. The method according to claim 1, comprising the further steps of:

providing a third mould (S3) for forming a liquid-drainage siphon (16) for the bottom of the pan (2);

forming the drainage siphon (16) by means of casting inside the third mould (S3), housing the drainage siphon (16) inside the casing (5) following insertion of the pan (2) and the rim (3) inside the casing (5);

joining the siphon (16) to the bottom of the pan (2).

5. The method according to claim 1, wherein said die (M) and said extractor (E) are configured, during use, with two further forming surfaces (45, 46) defining a projecting flange (13) of the rim (3).

6. A ceramic bowl obtained by means of casting in moulds using the method according to claim 1, comprising:

a liquid collection pan (2) having a main axis (Z) of extension;

a liquid distribution rim (3) having at least one portion configured to reproduce the top edge (7) of the pan (2) along a common plane (P) of the die; said portion having a tubular chamber (4) with toroidal cross-section for the passage of liquids and having as axis of rotation the said axis (Z) of the pan (2); said rim (3) and said pan (2) being made as a single body in a mould (S1);

a separate outer casing (5) for housing the single component formed by said pan (2) and said rim (3), wherein:

a first set of perimetral surfaces (8, 14, 31) which define one part of the tubular chamber (4) of the rim (3) and the surface joining the rim portion (3) to the pan (2) are parallel to each other and extend in a direction transverse to the common plane (P) of the die and a second set of perimetral surfaces (6, 12) which define the other part of the tubular chamber (4) extend parallel to the plane (P) of the die and are connected to the first set of surfaces (8, 14, 31) so as to configure continuous outer surfaces devoid of recesses or projections; one of the surfaces (12) of this second set defining the top wall of the tubular chamber (4), being provided with a projecting flange (13) forming a surface (3) for resting the rim (3) on a top surface (15) of the casing (5).

7. The bowl according to claim 6, wherein each surface (8, 14, 31) of the first set is oriented so as to converge towards the main axis (Z) of extension of the pan (2).

8. The bowl according to claim 6, wherein said perimetral surfaces (8, 14) of the first set forming one part of the tubular chamber (4) which are transverse to the common plane (P) of the die define the inner and outer side walls of the tubular chamber (4) with respect to the pan (2).

9. The bowl according to claim 6, wherein the tubular chamber (4) has a bottom surface (6) joined, at its end, to the top edge (7) of the joining surface (31) of the pan (2) so as to form, with the same surface (31), a substantial right angle ($\alpha$) which defines a projecting outer extended part of the pan (2) itself.

10. The bowl according to claim 6, wherein the rim portion (3) comprises a flange (8) inside the pan (2) extending substantially vertically and defining the inner side surface of the tubular chamber (4); said flange (8) being configured with at least a bottom free portion thereof partially facing the top edge (7) and the joining surface (31) of the pan (2) so as to define a discharge channel (9) for liquid passing through the tubular chamber (4).

11. The bowl according to claim 6, wherein the inner flange (8) defining the side surface of the tubular chamber (4) and the surface (31) joining the pan (2) are configured to obtain dimensional variations in their relative distance so as to define narrower zones or wider zones of the liquid discharge channel (9).

12. The bowl according to claim 11, wherein the inner flange (8) of the tubular chamber (4) has an intermediate portion (10) thereof which is joined to a section joining together the bottom surface (6) and top edge (7) of the pan (2) so as to configure a closed zone along the extension of the tubular chamber (4).

13. The bowl according to claim 6, wherein the bottom surface (6) of the tubular chamber (4) comprises protrusions (11) projecting towards the inside of the said tubular chamber (4) for distributing the passing liquid.

14. The bowl according to claim 6, comprising a liquid-drainage siphon portion (16) which is separate from the pan (2) and configured to be connected to the said pan (2) inside the casing (5).

15. The bowl according to claim 6, comprising a siphon portion (16) for draining the liquids from said pan (2), formed as a single body with said casing (5).

16. The bowl according to claim 6, wherein said rim (3) comprises a second rear portion (17) which is defined by an extended part of the portion generating the tubular chamber (4) and inside which a liquid supply channel (18) for the tubular chamber (4) is formed.

* * * * *